US010631098B2

(12) United States Patent
Clark et al.

(10) Patent No.: US 10,631,098 B2
(45) Date of Patent: Apr. 21, 2020

(54) PLANAR MAGNETIC LOUDSPEAKER AIRFLOW SYSTEM

(71) Applicant: MrSpeakers, LLC, San Diego, CA (US)

(72) Inventors: Daniel William Clark, San Diego, CA (US); Robert Jason Egger, San Diego, CA (US); Peter Robert Ryan, San Diego, CA (US)

(73) Assignee: MrSpeakers, LLC, San Diego, CA (US)

( * ) Notice: Subject to any disclaimer, the term of this patent is extended or adjusted under 35 U.S.C. 154(b) by 77 days.

(21) Appl. No.: 15/648,608

(22) Filed: Jul. 13, 2017

(65) Prior Publication Data

US 2018/0020292 A1 Jan. 18, 2018

Related U.S. Application Data

(60) Provisional application No. 62/361,759, filed on Jul. 13, 2016.

(51) Int. Cl.

| | |
|---|---|
| ***H04R 9/06*** | (2006.01) |
| ***H04R 13/00*** | (2006.01) |
| ***H04R 7/04*** | (2006.01) |
| ***H04R 9/04*** | (2006.01) |
| *H04R 1/28* | (2006.01) |
| *H04R 1/10* | (2006.01) |

(52) U.S. Cl.

CPC ..... *H04R 13/00* (2013.01); *H04R 7/04* (2013.01); *H04R 9/047* (2013.01); *H04R 9/06* (2013.01); *H04R 1/1008* (2013.01); *H04R 1/2811* (2013.01)

(58) Field of Classification Search

CPC ..... H04R 9/06; H04R 2499/11; H04R 1/00; H04R 2201/003; H04R 9/043

See application file for complete search history.

(56) References Cited

U.S. PATENT DOCUMENTS

| | | | | |
|---|---|---|---|---|
| 3,230,319 | A * | 1/1966 | Kliewer | H04R 7/122 181/137 |
| 6,044,160 | A | 3/2000 | Norris | |
| 6,151,398 | A | 11/2000 | Norris | |
| 7,146,019 | B2 | 12/2006 | Levitsky | |
| 8,335,340 | B2 * | 12/2012 | de Haan | H04R 9/047 381/431 |
| 9,002,043 | B2 | 4/2015 | Norris et al. | |
| 2005/0084122 | A1 | 4/2005 | Norris et al. | |
| 2005/0100181 | A1 | 5/2005 | Croft, III et al. | |
| 2005/0244016 | A1 | 11/2005 | Norris et al. | |
| 2005/0265570 | A1 * | 12/2005 | Isotalo | H04R 1/30 381/337 |
| 2008/0069395 | A1 * | 3/2008 | Levitsky | H04R 7/04 381/423 |
| 2008/0079558 | A1 | 4/2008 | Dorgelo et al. | |

(Continued)

*Primary Examiner* — Amir H Etesam

(74) *Attorney, Agent, or Firm* — Hall Estill Attorneys at Law; Tyler J. Mantooth

(57) ABSTRACT

A planar magnetic loudspeaker may employ an airflow system having a magnet array separated from a diaphragm. The magnet array can have a plurality of airflow apertures that are arranged in a pattern and each continuously extending through a thickness of the magnet array to increase the signal-to-noise ratio of the planar magnetic loudspeaker.

19 Claims, 7 Drawing Sheets

(56) References Cited

U.S. PATENT DOCUMENTS

| | | | | |
|---|---|---|---|---|
| 2009/0285439 | A1* | 11/2009 | Yuasa | H04R 1/06 381/412 |
| 2012/0087518 | A1 | 4/2012 | Simidian, II et al. | |
| 2015/0230011 | A1* | 8/2015 | Inoue | H04R 1/00 381/162 |

* cited by examiner

PLANAR MAGNETIC LOUDSPEAKER AIRFLOW SYSTEM

RELATED APPLICATION

The present application makes a claim of domestic priority to U.S. Provisional Patent Application No. 62/361,759 filed Jul. 13, 2016, the contents of which are hereby incorporated by reference.

SUMMARY OF THE INVENTION

A planar magnetic loudspeaker, in accordance with various embodiments, has a diaphragm separated from a first magnet array in a planar magnetic assembly with the magnet array having a bar magnet positioned in a non-magnetic tray that has a plurality of airflow apertures arranged on opposite sides of the bar magnet.

A diaphragm is separated from a first magnet array in a planar magnetic speaker assembly in assorted embodiments with the first magnet array having a plurality of airflow apertures separated in a pattern and each continuously extending through a thickness of the magnet array.

In some embodiments, a magnet array is positioned a separated distance from a diaphragm in a planar magnetic assembly with the magnet array having a plurality of airflow apertures arranged in a pattern. By passing electrical current through the magnet array to induce movement of the diaphragm, laminar airflow is provided through the magnet array to mitigate entropy, pressure wave diffraction, and pressure wave reflection of sound waves passing from the diaphragm through the magnet array.

DETAILED DESCRIPTION

Various embodiments are generally directed to structure that optimize airflow through a loudspeaker to enhance loudspeaker performance.

In planar magnetic loudspeaker and headphone drivers, magnets are arrayed on one or two sides of the driver diaphragm. A typical "symmetric" audio loudspeaker places bar magnets proximal to both sides of a driver while a single-ended audio loudspeaker places magnets proximal to one side of the driver. A driver with conductive traces is arranged relative to the magnets, which activates the transducer when an audio signal is sent through the traces.

Figure 1:
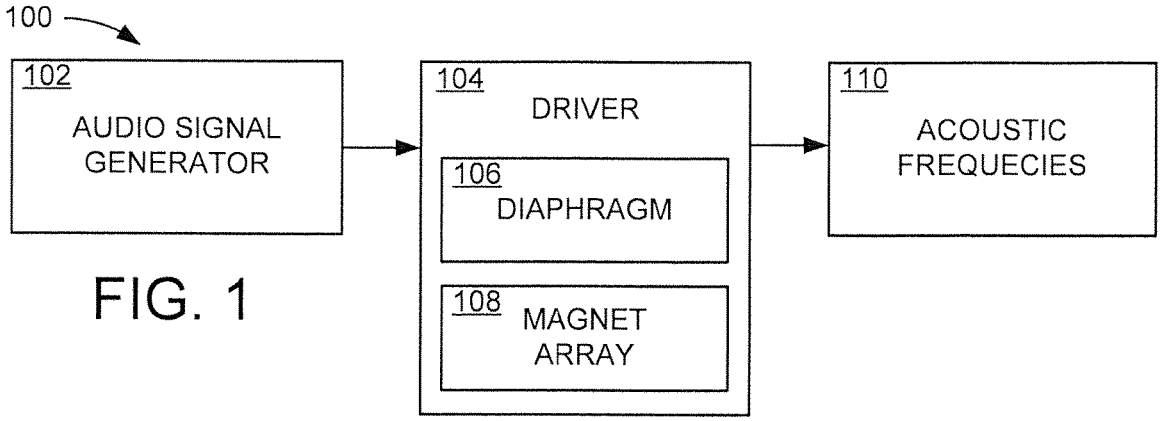
FIG. 1 provides a block representation of an example planar magnetic loudspeaker airflow system arranged in accordance with some embodiments.

FIG. 1 is a block representation of an example loudspeaker airflow system 100 arranged in accordance with various embodiments. The system 100 has one or more audio signal generators 102, such as an amplifier or signal processor, that are translated via at least one audio driver 104 having a diaphragm 106 and magnet array 108 into acoustic output 110.

Figure 2A:
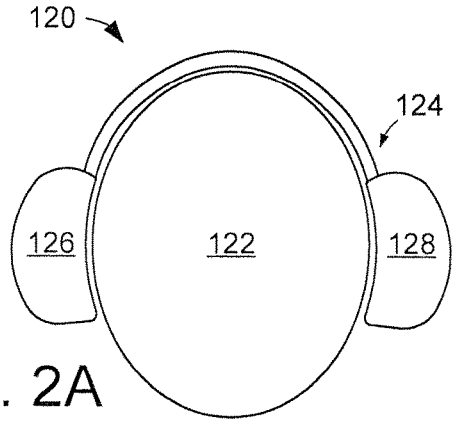
FIGS. 2A and 2B show representations of an example planar magnetic loudspeaker airflow system configured in accordance with various embodiments.
Figure 2B:
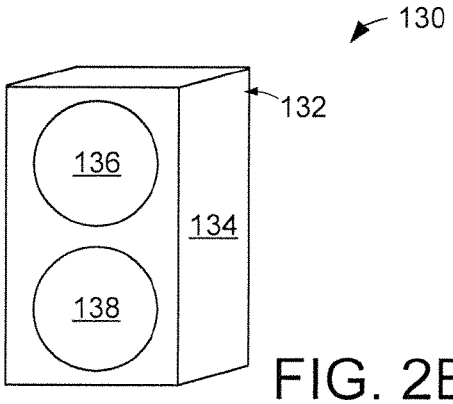

FIGS. 2A and 2B respectively display line representations of example acoustic driver systems 120 and 130 that are arranged and operated in accordance with various embodiments. In FIG. 2A, a user 122 is employing a pair of over-ear headphones 124 that has first 126 and second 128 acoustic drivers positioned proximal different ears of the user 122. It is noted that the over-ear configuration of the headphones 124 is not required as in-ear and on-ear arrangements may alternatively be used. Also, the number and style of acoustic drivers 126 and 128 are not limited and the headphones 124 may concurrently utilize numerous similar, or dissimilar, speakers.

The acoustic driver system 130 of FIG. 2B shows a stand-alone speaker 132 that is configured with a housing 134 that supports first 136 and second 138 acoustic drivers. The housing 134 can provide a volume of sealed or ported space behind the acoustic drivers 136 and 138 to allow for increased range and volume capabilities from the system 130 compared to the headphones 124 of FIG. 2A that have less available space.

Figure 3A:
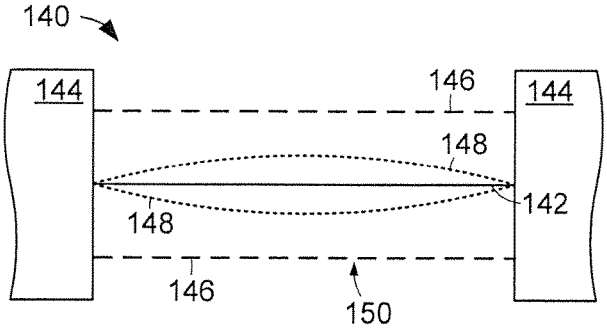
FIGS. 3A and 3B display line representations of portions of an example planar magnetic loudspeaker airflow system suitable for use in the systems of FIGS. 1 & 2.
Figure 3B:
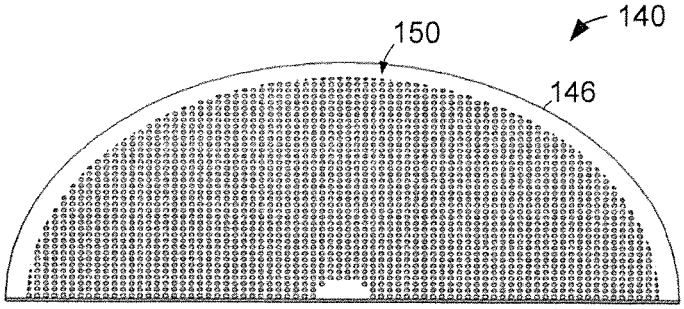

FIGS. 3A and 3B respectively show line representations of portions of an example electrostatic audio transducer 140 that may be employed in the airflow systems of FIGS. 1 & 2. The audio transducer 140 has a diaphragm 142 that continuously spans a baffle 144, such as a headphone baffle. It is noted that the diaphragm 142 may be physically connected to the baffle 144 via a diverse variety of appropriate means, such as adhesives and/or fasteners.

As shown in FIG. 3A, the diaphragm 142 is suspended between stators 146 that are electrically conductive. The stators 146 may be constructed as a screen, metal plate, or printed circuit board that allows high voltage alternating current (AC) to pass that attracts, or repels, the diaphragm 142 when the diaphragm 142 is energized with a high voltage direct current (DC). As the diaphragm 142 vibrates and moves, pressure waves 148 are created that extend outward towards the stators 146.

The stators 146 are physically thin and perforated with a number of holes 150 that can be positioned in an organized matrix of rows and columns, as shown in FIG. 3B, or numerous other patterns. The flat, thin, and perforated nature of stators allow the stator 146 to minimize pressure waves 148, diffractions, and reflections, which results in significantly lower harmonic distortion and higher audio resolution than can be obtained through the physical structure of magnets in planar magnetic designs. It is a goal of various embodiments of the present disclosure to reduce the pressure wave effects in a planar magnetic loudspeaker in order to behave more like the electrostatic audio transducer 140 of FIGS. 3A and 3B.

Figure 4A:
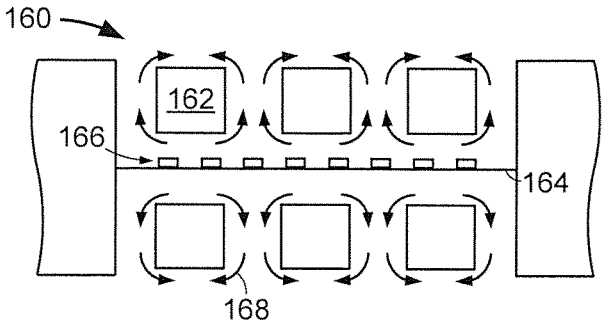
FIGS. 4A-4C respectively convey cross-sectional views of portions of an example planar magnetic loudspeaker capable of use in the systems of FIGS. 1 & 2.
Figure 4B:
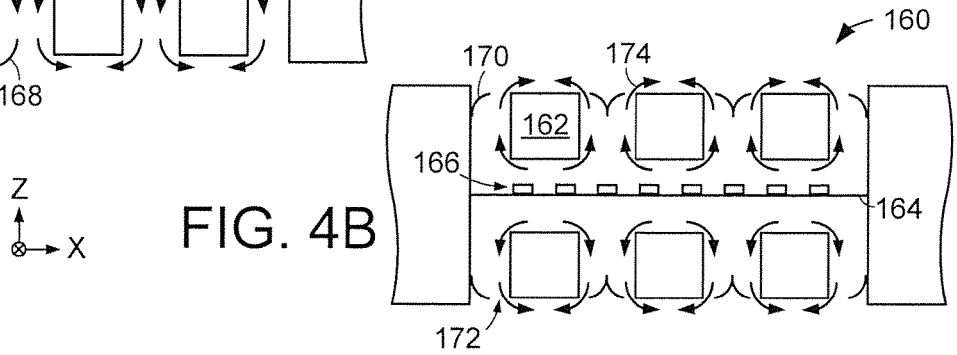
Figure 4C:
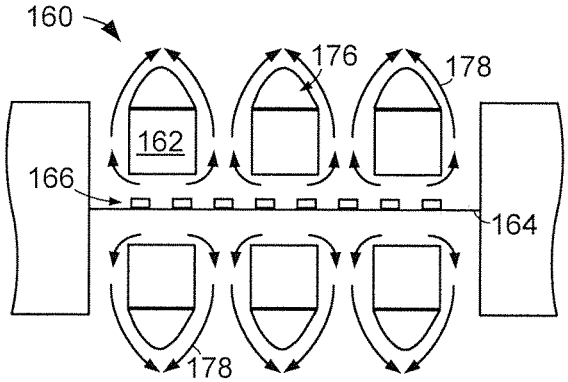

FIGS. 4A-4C illustrate a cross-sectional line representation of portions of an example planar magnetic loudspeaker 160 that may be utilized in an airflow system in accordance with some embodiments. FIG. 4A shows a "symmetric" audio loudspeaker where bar magnets 162 are placed proximal to one or both sides or a diaphragm 164 with conductive traces 166 arranged relative to the magnets 162 so as to activate the transducer 160 when an audio signal is sent through the traces 166.

As can be appreciated from the differences between FIGS. 4A, 4B, and 4C, there are several variations on the theme of magnet 162 structures relative to the driver 164. The non-limiting example of FIG. 4A shows a bar magnet-based planar magnetic loudspeaker with audio signals running through the conductive traces 166 that are physically attached to the diaphragm 164 within magnetic field created by magnets 162. As the driver 164 moves in response to the audio signal, pressure waves 168 flow around the bar magnets 162.

In FIG. 4B, the bar magnets 162 are positioned inside trays 170 that have perforations 172 placed at intervals between the magnets 162 and the respective trays 170 to allow airflow 174 created by displacement of the driver 164. Arranging the magnets 162 in a tray 170 can create complex nonlinear modalities as air pressure 174 experiences a combination of diffraction and reflection as the pressure wave passes the edges of the bar magnets 162, then encounters the tray 170, before exiting via perforations 172.

To address airflow concerns, shapes 176 can be placed proximal to each bar magnet 162, as shown in FIG. 4C. The shapes 176 attempt to prevent nonlinearities due to boundary conditions along the outside edge of the magnets 162, however airflow 178 still experiences diffraction and reflection events as the pressure wave moves around and between the magnets 162 as the wave is created by the driver, leaving right-angle edges adjacent to the driver. In all cases, the passage of air as pressure waves 168, 174, and 178 around the magnet array, or magnet-tray array, of a planar magnetic loudspeaker wave passes the edges of the magnets 162, which produces combinations of diffraction and reflection which increase entropy, decrease signal-to-noise ratio, and affect the linearity of the frequency resultant audio output of the loudspeaker 160.

It is noted that a dynamic loudspeaker may employ one or more bass ports to improve low-frequency extension for a given size loudspeaker enclosure. In these "ported" loudspeaker designs, air flows through one or more tubes to provide bass reinforcement. To reduce port noise and diffraction effects, flared couplers interface a bass port tube at opposing exterior and interior ends of the port, which smooth the transition from the tube to the surrounding air and reduces turbulence and thus non-linear airflow distortion products.

In accordance with various embodiments, airflow can be improved in a planar magnetic loudspeaker with at least one airflow feature that decreases entropy, pressure wave diffraction and pressure wave reflection while increasing signal-to-noise ratio and optimizing the linearity of audio output frequency. The assorted embodiments solves the problem of planar magnetic motor diffraction artifacts by enhancing the bar magnets, or magnet and tray assemblies, with an integrated airflow feature that fills the voids surrounding magnets to create a flat and perforated motor assembly with acoustic properties similar to the flat stators of electrostatic loudspeakers.

Figure 5:
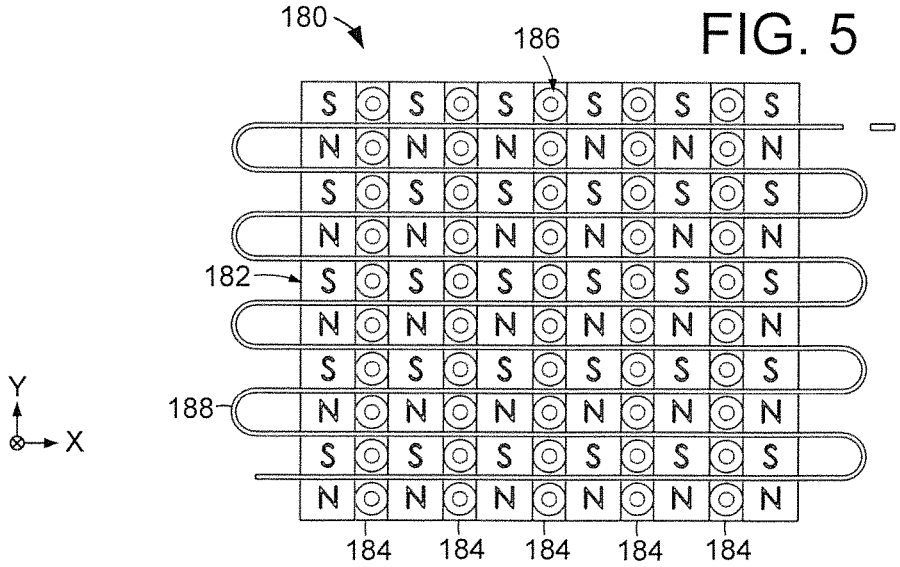
FIG. 5 is a top view representation of portions of an example driver capable of being utilized in the systems of FIGS. 1 & 2.

FIG. 5 displays a top view line representations of an example motor assembly 180 that is suitable for use in a planar magnetic loudspeaker in accordance with some embodiments. The motor assembly 180 has an array of bar magnets 182 separated by non-magnetic inserts 184. The inserts 184 contain a multiplicity of through holes shaped so as to minimize turbulence and regulate air load (damping) experienced by a diaphragm, such as diaphragm 164 of FIG. 4A. By replacing the rectangular voids between the magnets 182 with an array of aerodynamically optimized holes 186, the aggregate stator assembly appears to the driver to have the same acoustic properties as a flat stator, such as stator 146 of FIG. 3B.

The motor assembly 180 incorporates an electrically conductive trace 188 to produce an electromagnet. It is contemplated that the respective magnets 182 can be "programmed" to have various polarity pole patterns optimized to improve system performance. While traditional magnets 182 have one south and one north pole, the non-limiting embodiment of FIG. 5 shows the bar magnets 182 partitioned into sub-zones of different magnetic polarities that align to traces 188 in non-traditional ways that optimize performance in the "stator"-like flat planar magnetic motor assembly 180. It is noted that the various through hole apertures 186 can be any shape, size, and position to increase laminar airflow through the loudspeaker.

Figure 6:
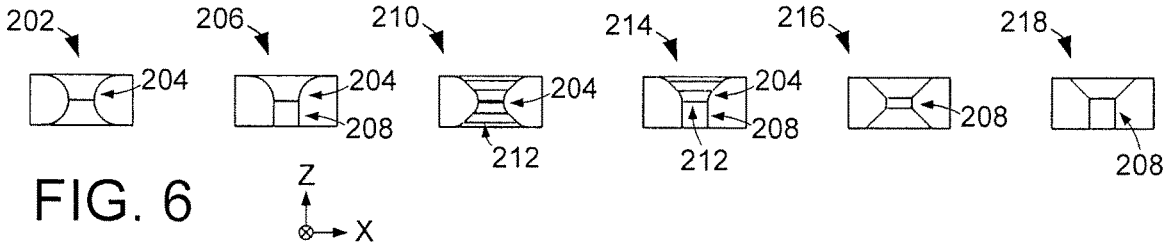
FIG. 6 illustrates cross-sectional views of various portions of an example loudspeaker airflow system arranged in accordance with some embodiments.

FIG. 6 depicts cross-sectional line representations of a variety of different through holes that can be individually, or collectively, utilized in a non-magnetic stator insert as part of an airflow feature. Non-limiting embodiments are shown where aperture 202 is configured with continuously curvilinear sidewalls 204 while aperture 206 has a combination of curvilinear 204 and linear 208 sidewalls. Aperture 210 illustrates how a curvilinear sidewall 204 can comprise a plurality of faceted faces 212 that can be sized to promote laminar airflow.

As shown in aperture 214, faceted faces 212 may be incorporated into some or all of the aperture 214. In apertures 216 and 218, multiple flat (linear) sidewalls 208 are oriented at different angles to define the respective holes. It is noted that the various apertures of FIG. 6 are not required and any combination of linear 208 and curvilinear 204 sidewalls can be used with any number of faceted faces 212. Sidewall treatments shown in FIG. 6 can be utilized on any shape through hole, such as round, oval, square, and other shapes.

Figure 7A:
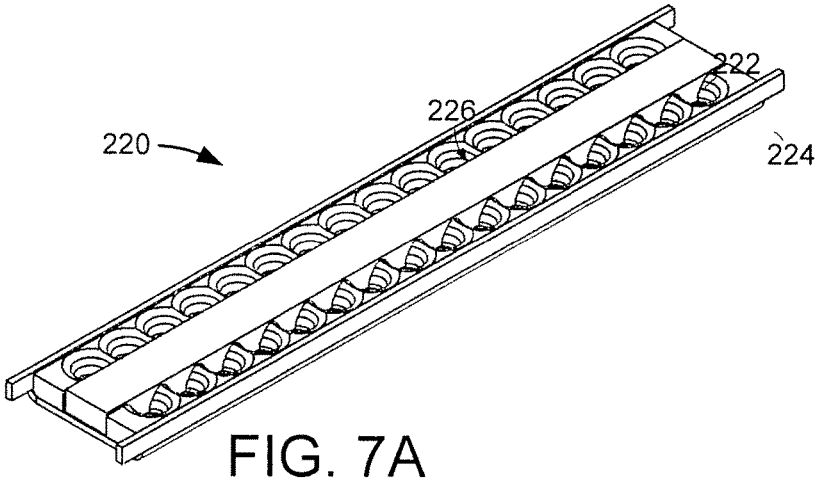
FIGS. 7A-7C depicts assorted views of portions of an example driver capable of being used in the systems of FIGS. 1 & 2.
Figure 7B:
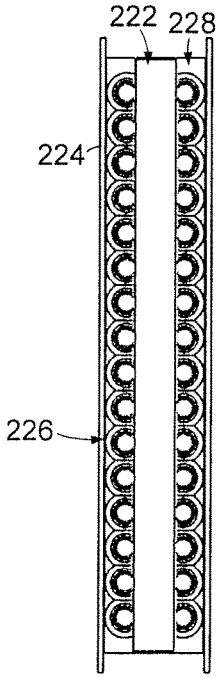

FIGS. 7A-7B depict different views of portions of an example insert 220 that can be characterized as an airflow feature that optimizes performance in a planar magnetic loudspeaker. FIG. 7A is a perspective line representation of the insert 220 with a bar magnet 222 positioned within a non-magnetic tray 224. The function of the tray 224 is to concentrate magnetic flux so as to increase the efficiency of the planar magnetic driver. The tray 224 is perforated with a series of holes 226 that allow audio waves to exit the driver.

Figure 7C:
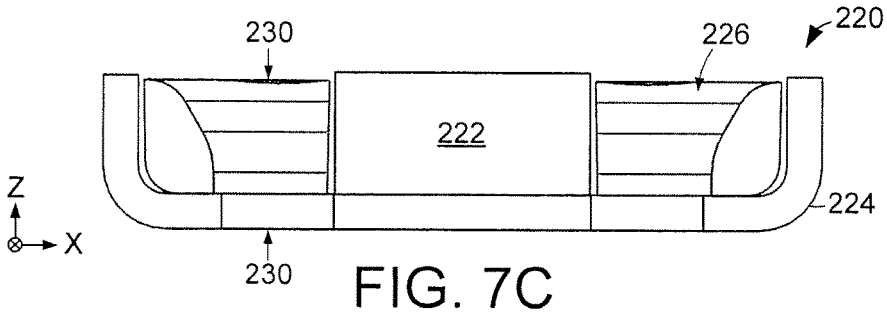

The top view of FIG. 7B shows how the non-magnetic tray 224 has non-magnetic material 228 that fills the area between the magnet 222 and the edges of the tray 224. The cross-sectional view of FIG. 7C shows how each hole 226 is shaped with multiple aligned air ports 230, of which one port 230 may be smaller than another port 230, as illustrated by the various apertures of FIG. 6. By replacing complex geometry with an aerodynamically designed airflow feature like insert 220, audio pressure wave turbulence caused by diffraction and reflection caused around magnet 222 and tray 224 is greatly reduced.

Figure 8A:
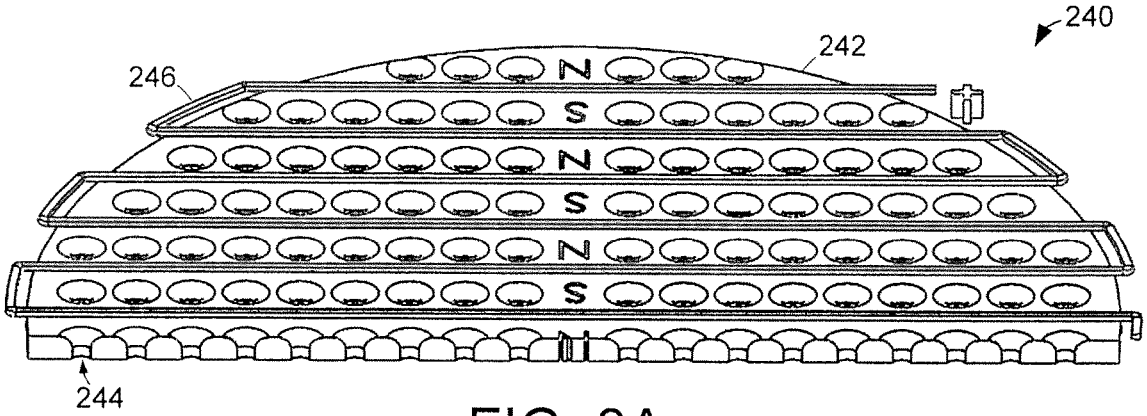
FIGS. 8A-8C show different views of an example driver configured in accordance with various embodiments.
Figure 8B:
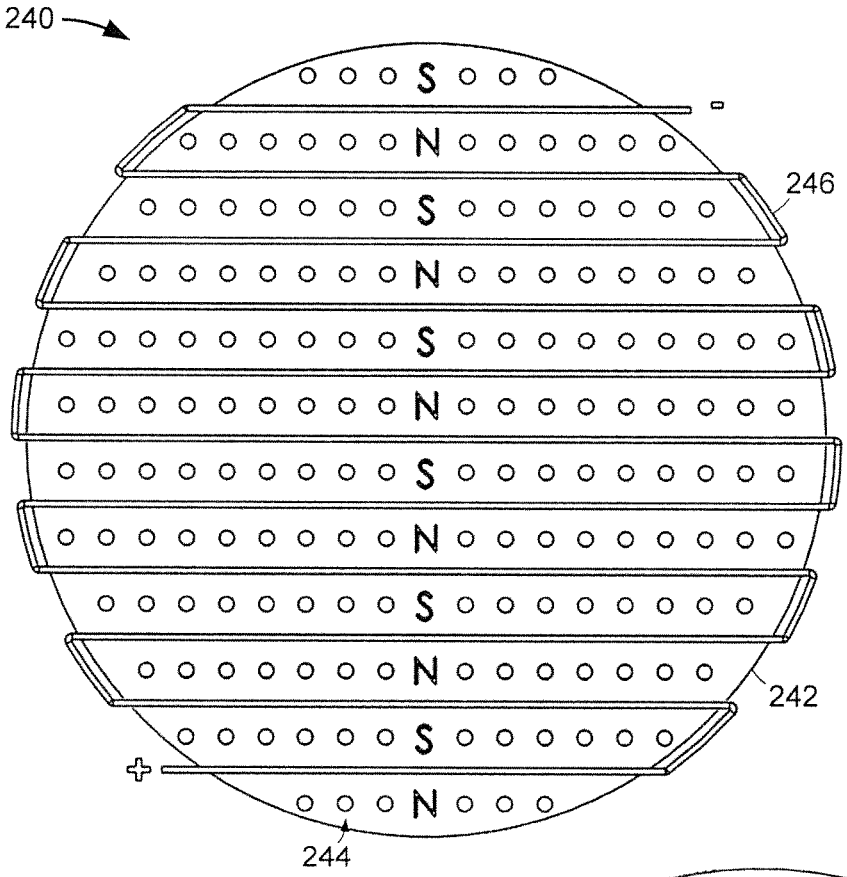
Figure 8C:
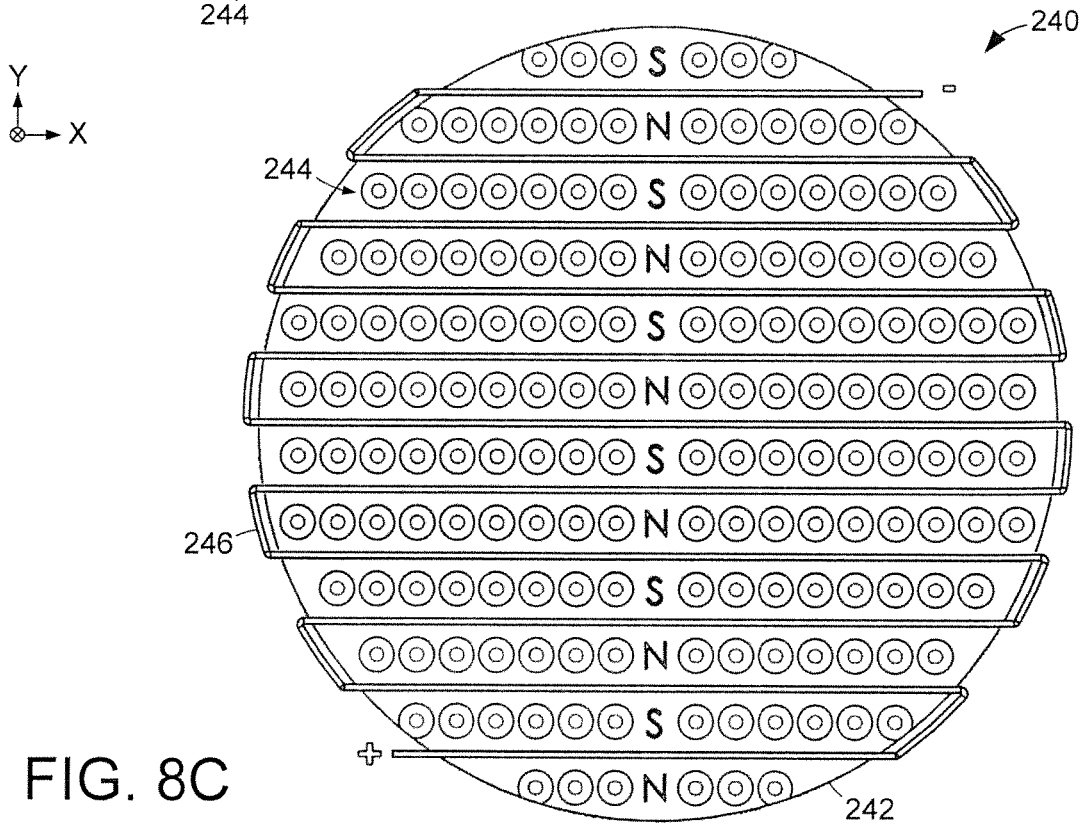

FIGS. 8A-8C respectively display line representations of portions of an example planar magnet assembly 240 that is configured in accordance to some embodiments to behave like an electrostatic stator. It is noted that a bonded magnet distributes magnetic material uniformly throughout the part, which can be molded to any arbitrary shape. Once the part is formed the magnetic field may be programmed using different magnetic geometries to support efficient driver operation. One such implementation of alternating rows of N/S poles, as shown in FIGS. 8A-8C, may be created, but various other patterns are possible.

The cross-sectional view of FIG. 8A shows how a single magnet layer 242 is programmed with different magnetic polarity sub-zones and a matrix of through holes 244. Each through hole 244 has a common shape with varying width, but such configuration is not required as different holes 244 in the matrix may have different shapes and/or sizes. That is, the bonded magnet layer 242 may be perforated with holes in a variety of shapes, including but not limited to round, oval, square etc. and the pattern may be symmetric or asymmetric, depending on the specific application needs.

The top view of FIG. 8B compares to the bottom view of FIG. 8C to illustrate how the various through holes 244 are aligned parallel to portions of the electrical trace 246. While each through hole 244 has a common diameter on the top surface of the magnet layer 242, it is contemplated that different through holes 244 have different diameters.

Figure 9A:
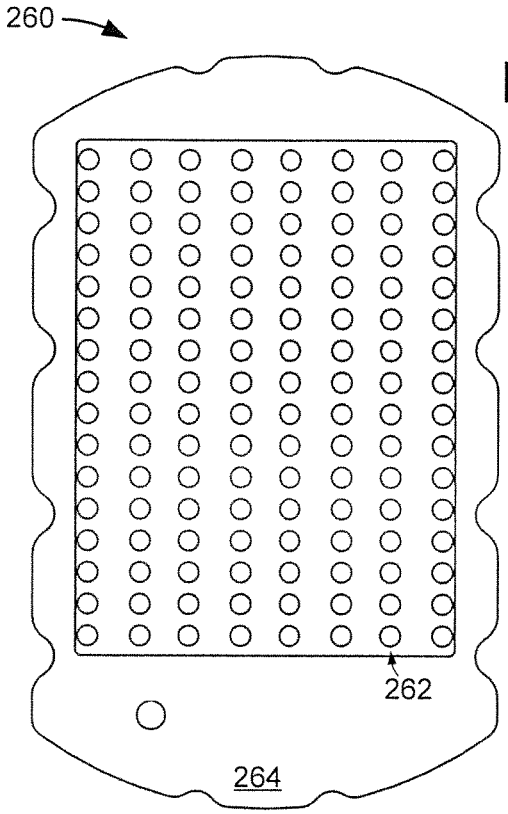
FIGS. 9A-9C display different views of an example airflow feature suitable for use in the systems of FIGS. 1 & 2.
Figure 9B:
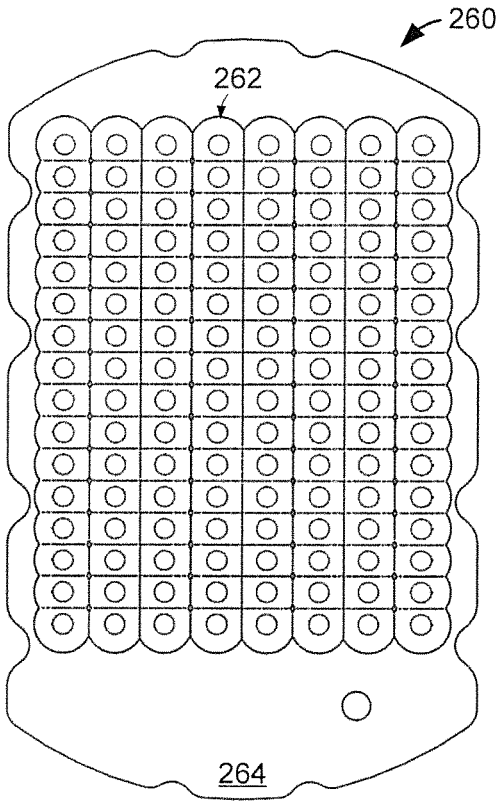
Figure 9C:
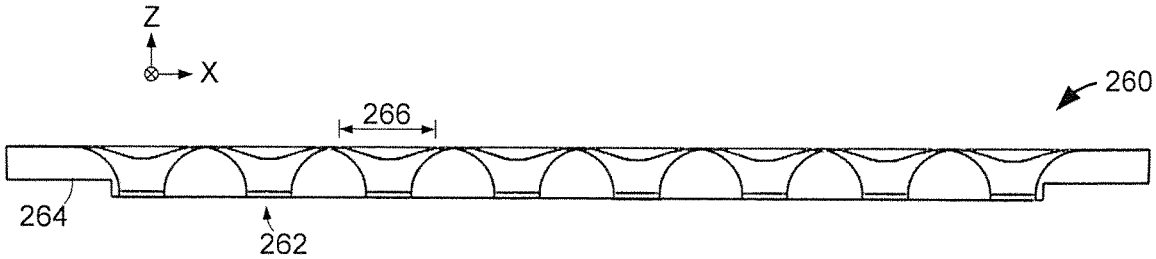

FIGS. 9A-9C respectively show an example airflow feature component 260 designed to supplement applications where the tray inserts 224 of FIG. 7A or spacers 184 of FIG. 5A do not present a symmetric airflow, and where symmetry is desired. Thus, the airflow feature component 260 can be configured with a plurality of through holes 262 organized in a pattern that mirrors the geometry of the magnet-in-tray through holes, such as holes 244 of FIG. 8A, and the holes themselves may be designed in accordance with features, such as those shown in FIG. 6.

FIG. 9A shows how the various through holes 262 can occupy less than all of a material 264, which may be a rigid, flexible, or semi-rigid and capable of being mounted in close physical proximity to a magnet array. FIGS. 9B and 9C conveys how the through holes 262 have varying aperture widths 266 from one side of the substrate 264 to the other, which can be tuned to optimize laminar airflow and loudspeaker performance. A component like this can be used in conjunction with a magnet-in-tracy to create symmetric paths for sound waves passing through magnet-in-tray motors, as shown in FIG. 11.

Figure 10A:
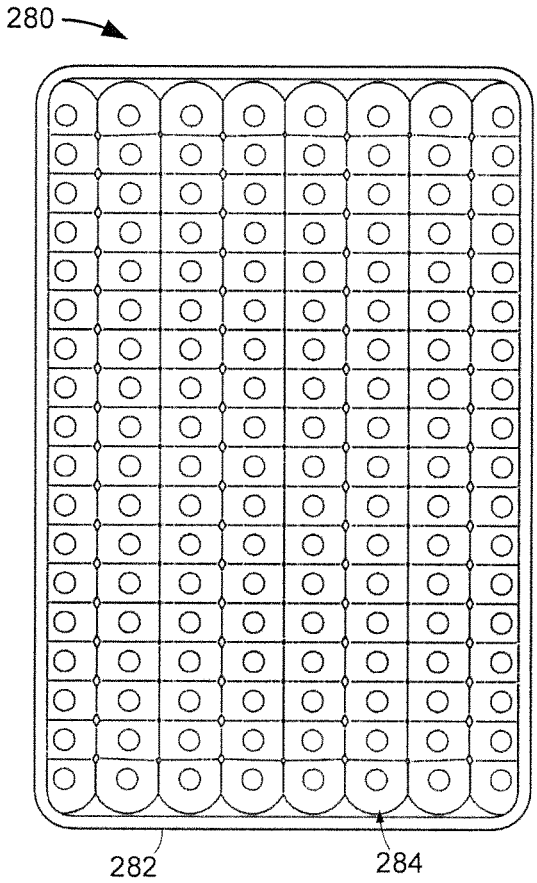
FIGS. 10A-10C convey assorted views of an example airflow feature suitable for use in the systems of FIGS. 1 & 2.
Figure 10B:
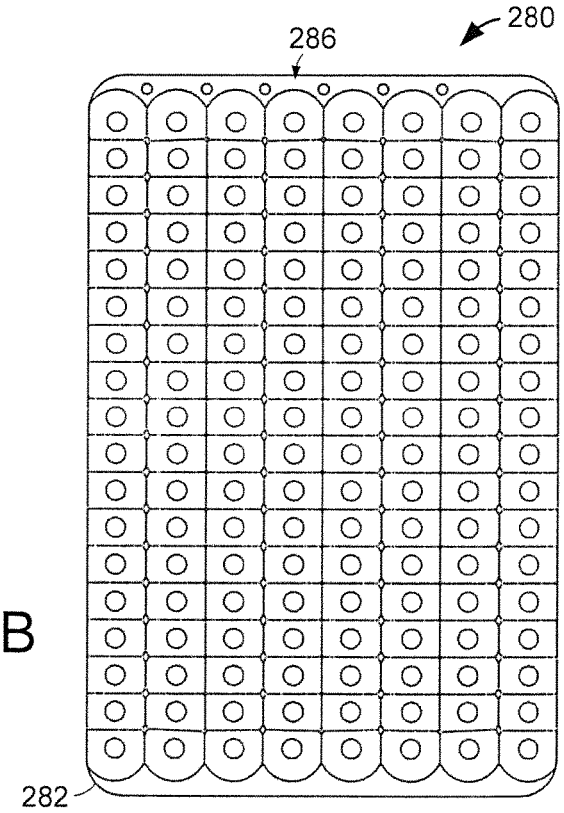
Figure 10C:
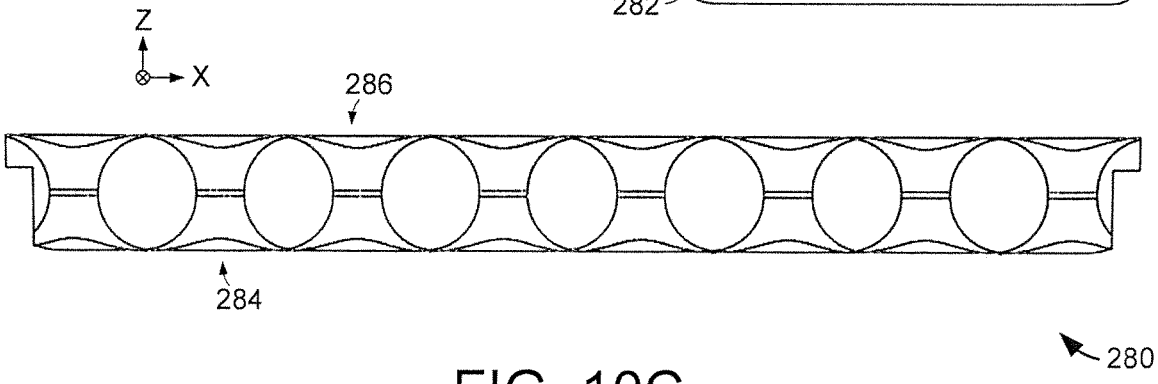

FIGS. 10A-10C respectively convey different views of an example airflow feature 280 that may be used in the airflow systems of FIGS. 1 & 2 in accordance with various embodiments. In single-ended planar magnetic designs where there is a motor on only one side of the driver, it is potentially desirable to create a symmetric load on the driver to improve performance. FIG. 10A shows a passive device with similar geometry to that of a magnet or magnet-in-tray assembly that is designed per the aforementioned inventions, such as a single-sided motor assembly.

The airflow feature 280 has a rigid frame 282 that defines a region occupied by a matrix of through holes 284 arranged in aligned rows and columns. The topside view of FIG. 10A illustrates how each through hole 284 decreases width towards a central plane. The bottom side view of FIG. 10B shows how bottom through holes 286 are aligned with each through hole 284 of FIG. 10A and has a decreasing width towards the central plane. The cross-sectional view of FIG. 10C conveys how the bottom holes 284 are aligned with, and a mirror image of, the top holes 286, which provides a Venturi effect that promotes laminar airflow through the feature 280. These features may be completely symmetric with the features of the planar magnetic motor, or they may be designed for a different, complementary effect.

Figure 11:
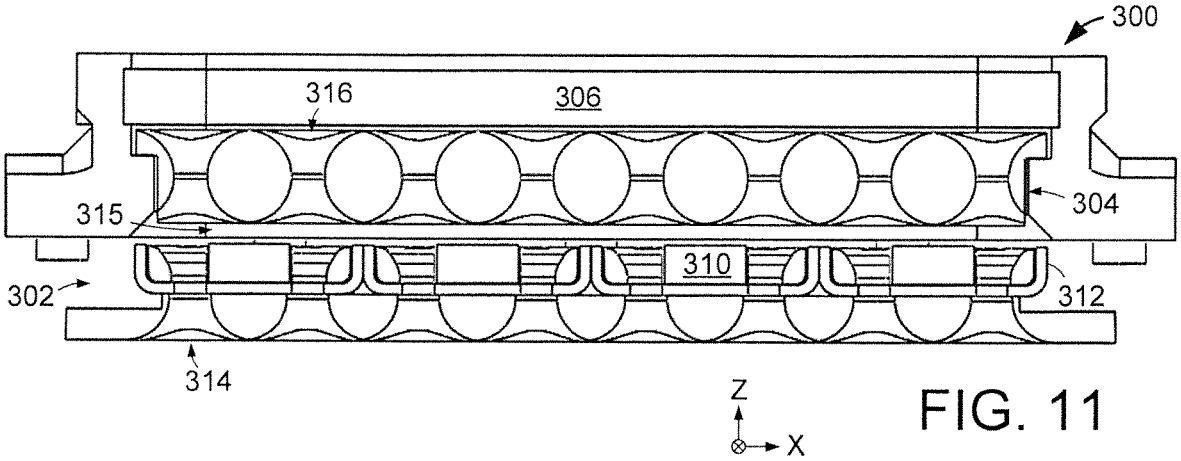
FIG. 11 is a cross-sectional line representation of a portion of an example loudspeaker constructed and operated in accordance with assorted embodiments.

FIG. 11 is a cross-sectional line representation of an assembled loudspeaker airflow system 300 that employs a magnet array 302 positioned proximal a first airflow feature 304. The first airflow feature 304 is disposed between the magnet array 302 and a headphone housing 306. The magnet array 302 has a number of physically separated bar magnets 310 positioned in a metal tray 312. The magnet array 302 is configured with airflow pathways 314 that taper with curvilinear sidewalls to encourage laminar pressure wave distribution into the air passages of the first airflow feature 304.

The respective airflow pathways 314 of the magnet array 302 may be characterized as a second airflow feature that acts in concert with the vertically aligned air pathways 314 of the first airflow feature 304 to reduce and/or eliminate pressure wave reflection and diffraction. It is noted that the magnet array 302 has a third airflow feature in the means of a shaped foil, distal the first airflow feature, much like foil 178 of FIG. 4C. The cross-sectional view of FIG. 11 displays how the first airflow feature 304 can be utilized in concert with the air pathways 314 of the magnet array 302 to provide non-turbulent pressure wave flow from the magnet array 302 outward towards the housing 306.

Figure 12A:
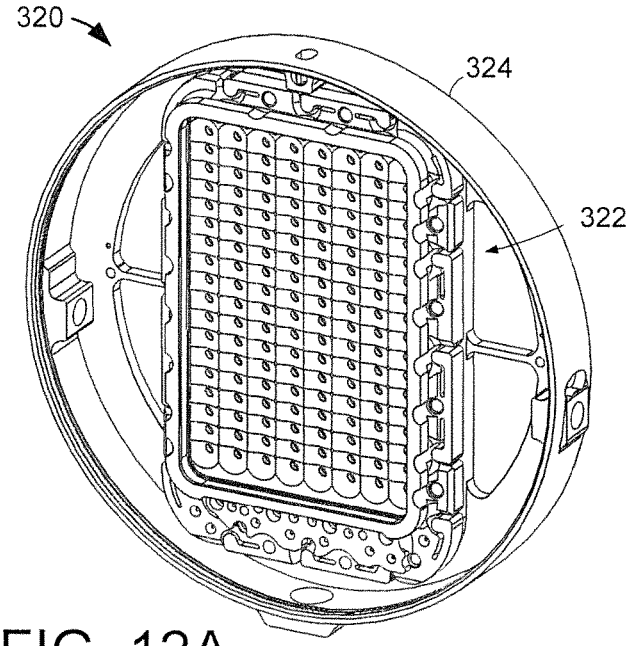
FIGS. 12A and 12B provide perspective view line representations of an example loudspeaker configured in accordance with various embodiments.
Figure 12B:
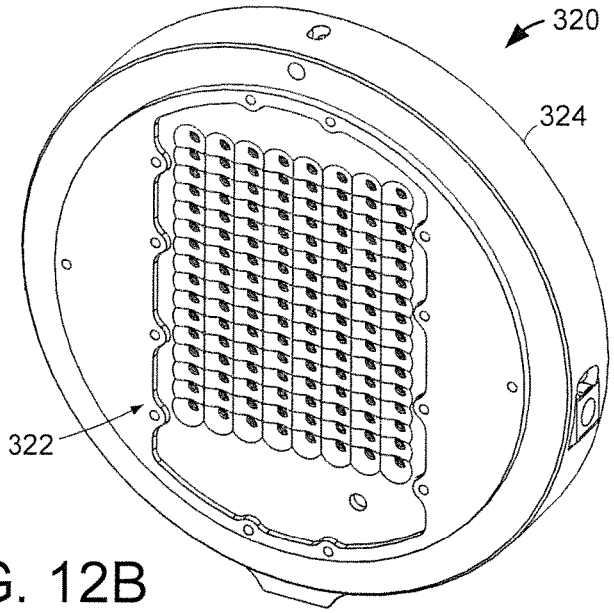

FIGS. 12A and 12B respectively display perspective view line representations of front and back portions of an assembled loudspeaker 320. FIG. 12A illustrates how an airflow assembly 322 is positioned in a loudspeaker housing 324. The airflow assembly 322 may comprise any number of airflow features, such as the feature 304 and pathway 314 of FIG. 11. It is contemplated that the airflow assembly 322 comprises a magnet array that is separated from, but operates in concert with, the air pathways having varying widths.

FIG. 12B conveys a back view of the loudspeaker 320 that shows how the airflow assembly can have a matrix of varying width through holes on opposite sides of a magnet array. By placing varying width through holes on opposite sides of the magnet array, pressure differential can be optimized so that airflow is laminar throughout the loudspeaker 320, regardless of the frequency and intensity of audio signal being reproduced.

It is noted that FIGS. 11-12B respectively convey detail of one possible example of a potential complete implementation for the purpose of smoothing airflow through the previously described airflow modification approaches. This example shows a magnet 310 in tray 312 with airflow tray spacer 315. Holes 316 can be drilled, or molded through load balancer 304, spacer 315, and exit plate 314 with symmetric or asymmetric holes with cylindrical, beveled, faceted, or smoothed contoured surfaces, as previously described under various embodiments. The inlets and or outlets of each hole being contoured in many different ways reduce unsteady airflow along the boundary layer. In addition, the contouring features can be applied to electrostatic stators to reduce nonlinearities. Such holes can take any shape, (round, square etc. . . . ) depending on the application.

The aforementioned embodiments may be used in any planar magnetic audio transducer, single ended or balanced, bar magnet or bar magnets in trays, loudspeaker or headphones. They can also be introduced to enhance the performance of systems utilizing shapes, such as shape 176 of FIG. 4C, to reduce turbulence.

It is noted that through various embodiments of the present disclosure:

1) Air gaps are filled between the magnets and trays with an insert to smooth airflow through the assembly.

2) Voids are filled between bar magnets with inserts 4 with the option to vary the magnet pole structures to optimize system performance.

3) A bonded magnet can be formed that is flat and relatively thin but perforated with through-holes and options to vary the magnet pole structures to optimize system performance.

4) At least one component may be applied to magnet/tray assemblies to further improve airflow through the system 5) A passive assembly can create a symmetric airflow load/path in applications where a single-ended motor is used but a symmetric air-load on the driver is desired.

6) A passive assembly for magnet and tray designs to be placed on opposite sides of the trays from the magnet to mirror the airflow from the magnet side of the tray that controls the pressure wave as it exits the magnet-in-tray assembly.

7) Applying the principal of smoother airflow through an electrostatic stator by also shaping the through-holes in the stator It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular application without departing from the spirit and scope of the present invention.

What is claimed is:

1. A planar magnetic loudspeaker comprising a diaphragm separated from a first magnet array in a planar magnetic assembly, the magnet array comprising a first bar magnet positioned between, and contacting, a first non-magnetic insert and a second non-magnetic insert in a plane parallel to a longitudinal axis of the diaphragm, each non-magnetic insert having a plurality of airflow apertures arranged in an aperture pattern, wherein the first magnet array comprising a single piece of material defining a plurality of airflow apertures arranged in a plurality of rows and separated in a pattern and each continuously extending through a thickness of the magnet array.

2. The planar magnetic loudspeaker of claim 1, wherein the first bar magnet, a second bar magnet, and the plurality airflow apertures of each non-magnetic insert are aligned along a plane parallel to the diaphragm.

3. The planar magnetic loudspeaker of claim 1, wherein each airflow aperture continuously extends to create an airflow pathway from the diaphragm between the first bar magnet and a second bar magnet.

4. The planar magnetic loudspeaker of claim 1, wherein each airflow aperture has a common cross-sectional shape.

5. The planar magnetic loudspeaker of claim 1, wherein a first airflow aperture of the plurality of airflow apertures has a first cross-sectional shape and a second airflow aperture of the plurality of airflow apertures has a second cross-sectional shape, the first and second cross-sectional shapes being different.

6. The planar magnetic loudspeaker of claim 1, wherein non-magnetic material is positioned between the airflow apertures as part of the non-magnetic insert.

7. The planar magnetic loudspeaker of claim 1, wherein at least one airflow aperture of the plurality of airflow apertures has a varying diameter along an axis extending perpendicular to the diaphragm.

8. The planar magnetic loudspeaker of claim 1, wherein the airflow apertures each continuously extend from a first side of the bar magnet to a second side of the bar magnet.

9. The planar magnetic loudspeaker of claim 1, wherein the airflow apertures are aligned in a row on the opposite sides of the bar magnet parallel to a longitudinal axis of the bar magnet.

10. The apparatus of claim 1, wherein the first magnet array is a single magnet layer.

11. The apparatus of claim 10, wherein the first single magnet layer has alternating magnetic polarity sub-zones.

12. The apparatus of claim 1, wherein each airflow aperture of the plurality of airflow apertures has a common shape along a plane parallel to the diaphragm.

13. The apparatus of claim 1, wherein each airflow aperture of the plurality of airflow apertures has a varying width along a plane perpendicular to the diaphragm and parallel to the thickness of the first magnetic array.

14. The apparatus of claim 1, wherein the diaphragm is suspended between first and second magnet arrays.

15. The apparatus of claim 14, wherein the second magnet array is arranged to match the first magnet array.

16. The apparatus of claim 14, wherein a plurality of airflow apertures of the second magnet array is arranged differently than the plurality of airflow apertures of the first magnet array.

17. A method comprising: positioning a first magnet array a separated distance from a diaphragm in a planar magnetic assembly, the first magnet array comprising first and second bar magnets having a plurality of airflow apertures present in a non-magnetic insert positioned between and contacting the first and second bar magnets; passing electrical current through the magnet array to induce movement of the diaphragm; and providing laminar airflow through the first magnet array to mitigate entropy, pressure wave diffraction, and pressure wave reflection of sound waves passing from the diaphragm through the first magnet array, wherein the first magnet array comprising a single piece of material defining a plurality of airflow apertures arranged in a plurality of rows and separated in a pattern and each continuously extending through a thickness of the magnet array.

18. The method of claim 17, wherein the signal-to-noise ratio of the planar magnetic assembly is linear with respect to audio output.

19. The method of claim 17, wherein each airflow aperture of the plurality of airflow apertures have a varying width to minimize turbulent pressure wave reflection and diffraction.

* * * * *